United States Patent [19]

Frankel et al.

[11] 4,328,005

[45] May 4, 1982

[54] POLYNITRO ALKYL ADDITIVES FOR LIQUID HYDROCARBON MOTOR FUELS

[75] Inventors: Milton B. Frankel, Tarzana; Joseph E. Flanagan, Woodland Hills, both of Calif.

[73] Assignee: Rockwell International Corporation, El Segundo, Calif.

[21] Appl. No.: 195,988

[22] Filed: Oct. 10, 1980

[51] Int. Cl.[3] ..... C10L 1/18; C10L 1/22

[52] U.S. Cl. ..... 44/57; 44/71; 44/66; 44/72; 44/77

[58] Field of Search ..... 44/71, 72, 57, 66, 77

[56] References Cited

U.S. PATENT DOCUMENTS

| | | | |
|---|---|---|---|
| 2,387,279 | 10/1945 | McCracken | 44/57 |
| 2,387,403 | 10/1945 | McCracken | 44/57 |
| 3,044,864 | 7/1962 | Ryder | 44/72 |
| 3,316,311 | 4/1967 | Plummer | 44/72 |
| 3,900,297 | 8/1975 | Michaels | 44/72 |

FOREIGN PATENT DOCUMENTS

| | | | |
|---|---|---|---|
| 543669 | 3/1942 | United Kingdom | 44/72 |

*Primary Examiner*—Jacqueline V. Howard

*Attorney, Agent, or Firm*—H. F. Hamann; Harry B. Field

[57] ABSTRACT

A family of liquid hydrocarbon motor fuel additives known as polynitro alkyls having the general formula $R_1—C(NO_2)_2—R_2$ have been found to enhance the overall combustion characteristics of motor fuels by increasing combustion efficiency and reducing undesirable combustion by-products.

15 Claims, No Drawings

POLYNITRO ALKYL ADDITIVES FOR LIQUID HYDROCARBON MOTOR FUELS

BACKGROUND OF THE INVENTION

1. Field of the Invention

This invention relates to liquid hydrocarbon motor fuel additives and, more specifically, to liquid hydrocarbon motor fuels improved by the addition of a minor proportion of a polynitro alkyl of the general formula $R_1—C(NO_2)_2—R_2$.

2. Description of the Prior Art

Combustion and thermal efficiency of motor fuels have become of primary importance in the automotive industry. Futhermore, not only is it vital to obtain the optimum amount of energy out of fuels, but it is similarly important to burn these fuels completely without the formation of soot and other pollutants. It has been found that various additives can be introduced into diesel or gasoline fuels to enhance the combustion rate, improve octane ratings for gasoline and cetane ratings for diesel fuel, and in general improve the quality of combustion within an internal or Stirling combustion engine.

Additionally, it has been found that the ignition quality of fuel can be improved by the addition of small amounts of certain adjuvants which act as ignition accelerators. This offers a means for improving the better grades of diesel fuels and of gasolines, and as a result widens the range of available fuel qualities by raising the ignition quality of lower grades of fuels to a point where they can be satisfactorily used.

SUMMARY OF THE INVENTION

In accordance with the present invention, there is provided a family of liquid hydrocarbon motor fuel additives known as polynitro alkyls having the general formula $R_1—C(NO_2)_2—R_2$. Specifically, the gem dinitro alkyls, those wherein $R_1$ is a lower alkyl radical and the trinitromethyls, where $R_1$ is an $—NO_2$ radical, and mixtures thereof have been particularly useful in increasing combustion and thermal efficiency and reducing pollutants generated in internal combustion and Stirling-type engines.

OBJECTS OF THE INVENTION

Therefore, it is an object of the present invention to provide a liquid hydrocarbon motor fuel having fuel additives capable of increasing combustion efficiency.

Another object of the present invention is to provide a liquid hydrocarbon motor fuel having fuel additives capable of improving thermal efficiency.

Yet another object of the present invention is to provide a liquid hydrocarbon motor fuel having an additive capable of enhancing ignition characteristics.

Still another object of the present invention is to provide a liquid hydrocarbon motor fuel having an additive capable of decreasing pollution by-products generated during combustion.

Another object of the present invention is to provide a liquid hydrocarbon motor fuel having an additive capable of increasing the octane rating of gasoline.

A further object of the present invention is to provide a liquid hydrocarbon motor fuel additive capable of enhancing the cetane rating of diesel fuel.

Other objects, advantages and novel features of the present invention will become apparent from the following detailed description of the invention.

DESCRIPTION OF THE PREFERRED EMBODIMENTS

In accordance with the present invention, there is provided a family of liquid hydrocarbon motor fuel additives known as polynitro alkyls having the general formula $R_1—C(NO_2)_2—R_2$. Specifically, it has been found that the gem dinitro alkyls, those where $R_1$ is H or a lower alkyl radical, and the trinitromethyls, where $R_1$ is an $—NO_2$ radical, and mixtures thereof have been particularly useful in increasing combustion efficiency and reducing pollutants generated in internal combustion and Stirling-type engines.

In both the case of the gem dinitro alkyl and the trinitromethyl, $R_2$ represents a radical selected from the group consisting of alkyl, alkyl hydroxy, cyano alkyl, secondary alkyl ethers, alkyl esters, nitro alkyls, nitrate esters, and mixtures thereof. These adjuvants can be added to the petroleum motor fuel in any combination and in quantities ranging from about greater than 0 to less than about 1.0 volume percent. The preferred volume percent ranges from about 0.2 to 0.4.

For the gem dinitro alkyls, $R_1$ is H, or a lower alkyl selected from the group of methyl, ethyl, propyl, butyl and mixtures thereof. The preferred alkyls are methyl and thyl, while the most preferred is methyl.

By way of illustration and not limitation, the following radicals and reaction equations are provided as examples:

The preferred alkyl radicals are those of $—CH_3$ and $—C_2H_5$ and the most preferred is $—CH_3$. The most preferred trinitromethyl alkyl can be prepared in accordance with the following reaction:

$$KC(NO_2)_3+CH_3I\rightarrow(NO_2)_3C\ CH_3+KI$$

Similarly, the gem dinitro alkyl can be prepared as follows:

$$KC(NO_2)_2CH_3+CH_3I\rightarrow CH_3(NO_2)_2C\ CH_3+KI$$

The preferred alkyl hydroxy radicals are those of $—CH_2OH$, and $—C_2H_4OH$ and the most preferred is $—CH_2OH$. The most preferred trinitromethyl alkyl hydroxy can be prepared in accordance with the following reaction:

$$HC(NO_2)_3+CH_2O\rightarrow(NO_2)_3C\ CH_2OH$$

Similarly, the gem dinitro alkyl can be prepared as follows:

$$HC(NO_2)_2CH_3+CH_2O\rightarrow CH_3(NO_2)_2CCH_2OH$$

The preferred cyano alkyl radicals are those of $—CH_2CN$ and $—C_2H_4CN$ and the most preferred is $—C_2H_4CN$. The most preferred trinitromethyl cyano alkyl can be prepared in accordance with the following reaction:

$$HC(NO_2)_3+CH_2=CHCN\rightarrow(NO_2)_3\ CCH_2CH_2CN$$

Similarly, the gem dinitro cyano alkyl can be prepared as follows:

$$HC(NO_2)_2CH_3 + CH_2{=}CHCN \rightarrow CH_3\text{-}(NO_2)_2CCH_2CH_2CN$$

The preferred secondary alkyl ethers are of the general formula $CH_2{=}CHOR_3$ wherein $R_3$ is an alkyl radical having from 1 to 5 carbon atoms, and preferrably 1–3 carbon atoms. The preferred trinitromethyl secondary alkyl ethers can be prepared in accordance with the following reaction:

$$CH_2{=}CHOR_3 + HC(NO_2)_3 \longrightarrow CH_3{-}\underset{\underset{H}{|}}{\overset{\overset{OR_3}{|}}{C}}{-}C(NO_2)_3$$

Similarly, the gem dinitro secondary alkyl ether can be prepared as follows:

$$CH_2{=}CHOR_3 + HC(NO_2)_2CH_3 \longrightarrow CH_3{-}\underset{\underset{H}{|}}{\overset{\overset{OR_3}{|}}{C}}{-}C(NO_2)_2CH_3$$

The preferred alkyl esters are those of the general formula $R_1C(NO_2)_2CH_2CH_2CO_2R_4$, wherein $R_1$ is H, a lower alkyl, or nitro and $R_4$ is a radical selected from the group consisting of alkyl, alkyl hydroxy, cyano alkyl, primary alkyl ether, nitro alkyl, nitrate ester and mixtures thereof. As examples, the preferred trinitromethyl alkyl ester can be prepared in accordance with the following reactions.

$$HC(NO_2)_3 + CH_2{=}CHCO_2H \longrightarrow (NO_2)_3CCH_2CH_2CO_2H \xrightarrow{HOCH_2CH_3} (NO_2)_3C(CH_2)_2CO_2\,CH_2\,CH_3$$

$$HC(NO_2)_3 + CH_2{=}CHCO_2H \longrightarrow (NO_2)_3CCH_2CH_2CO_2H \xrightarrow{HOCH_2CH_2OH} (NO_2)_3C(CH_2)_2CO_2(CH_2)_2OH$$

$$HC(NO_2)_3 + CH_2{=}CHCO_2H \longrightarrow (NO_2)_3CCH_2CH_2CO_2H \xrightarrow{HOCH_2CH_2CN} (NO_2)_3C(CH_2)_2CO_2(CH_2)_2CN$$

$$HC(NO_2)_3 + CH_2{=}CHCO_2H \longrightarrow (NO_2)_3CCH_2CH_2CO_2H \xrightarrow{HOCH_2CH_2ONO_2} (NO_2)_3C(CH_2)_2CO_2(CH_2)_2ONO_2$$

$$HC(NO_2)_3 + CH_2{=}CHCO_2H \longrightarrow (NO_2)_3CCH_2CH_2CO_2H \xrightarrow{HOCH_2C(NO_2)_3} (NO_2)_3C(CH_2)_2CO_2CH_2C(NO_2)_3$$

Similarly, the gem dinitro alkyl ethers can be prepared as follows:

$$HC(NO_2)_2CH_3 + CH_2{=}CHCO_2H \longrightarrow CH_3(NO_2)_2CCH_2CH_2CO_2H \xrightarrow{HOCH_2CH_3} CH_3(NO_2)CCH_2CH_2CO_2CH_2CH_3$$

$$HC(NO_2)_2CH_3 + CH_2{=}CHCO_2H \longrightarrow CH_3(NO_2)_2CCH_2CH_2CO_2H \xrightarrow{HOCH_2CH_2OH} CH_3(NO_2)_2C\,(CH_2)_2CO_2(CH_2)_2OH$$

$$HC(NO_2)_2CH_3 + CH_2{=}CHCO_2H \longrightarrow CH_3(NO_2)_2CCH_2CH_2CO_2H \xrightarrow{HOCH_2CH_2CN}$$

-continued $$CH_3(NO_2)_2C(CH_2)_2CO_2(CH_2)_2CN$$

$$HC(NO_2)_2CH_3 + CH_2{=}CH_2\,CHCO_2H \longrightarrow CH_3(NO_2)_2CCH_2CH_2CO_2H \xrightarrow{HOCH_2CH_2ONO_2} CH_3(NO_2)_2C(CH_2)_2CO_2(CH_2)_2ONO_2$$

$$HC(NO_2)_2CH_3 + CH_2{=}CH_2\,CHCO_2H \longrightarrow CH_3(NO_2)_2CCH_2CH_2CO_2H \xrightarrow{HOCH_2C(NO_2)_3} CH_3(NO_2)_2\,C\,(CH_2)_2CO_2CH_2C(NO_2)_3$$

Thus, it is apparent that there is provided by this invention adjuvants for liquid hydrocarbon motor fuels.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A liquid hydrocarbon motor fuel comprising a minor portion of a polynitro alkyl of the general formula $R_1C(NO_2)_2{-}R_2$ wherein $R_1$ represents a radical selected from the group consisting of H, $-NO_2$, lower alkyls and mixtures thereof and wherein $R_2$ is selected from the group consisting of $-CH_2CN$, $-C_2H_4CN$ and mixtures thereof.

2. The liquid hydrocarbon motor fuel of claim 1 wherein $R_2$ is $-C_2H_4CN$.

3. A liquid hydrocarbon motor fuel comprising a minor portion of a polynitro alkyl of the general formula $R_1C(NO_2)_2{-}R_2$ wherein $R_1$ represents a radical selected from the group consisting of H, $-NO_2$, lower alkyls and mixtures thereof and wherein $R_2$ is selected from the group secondary alkyl ethers consisting of $$CH_3{-}\underset{\underset{C(NO_2)_3}{|}}{C}OR_3$$

wherein $R_3$ is an alkyl radical having from 1 to 5 carbon atoms and mixtures thereof.

4. The liquid hydrocarbon motor fuel of claim 3 wherein $R_3$ is an alkyl radical having from 1 to 3 carbon atoms and mixtures thereof.

5. A liquid hydrocarbon motor fuel comprising a minor portion of a polynitro alkyl of the general formula $R_1C(NO_2)_2{-}R_2$ and wherein $R_1$ represents a radical selected from the group consisting of H, $-NO_2$, lower alkyls and mixtures thereof and wherein $R_2$ is selected from the group consisting of alkyl ester radicals of the general formula $-CH_2CH_2CO_2R_4$ wherein $R_4$ is a radical selected from the group consisting of alkyl, alkyl hydroxy, cyano alkyl, primary alkyl ether, nitro alkyl, nitrate ester, and mixtures thereof.

6. The liquid hydrocarbon motor fuel of claim 5 wherein $R_4$ is selected from the group consisting of $-CH_3$ and $-C_2H_5$ and mixtures thereof.

7. The liquid hydrocarbon motor fuel of claim 5 wherein $R_4$ is selected from the group consisting of $-CH_2OH$ and $-C_2H_4OH$ and mixtures thereof.

8. The liquid hydrocarbon motor fuel of claim 5 wherein $R_4$ is selected from the group consisting of $-CH_2CN$ and $-C_2H_4CN$ and mixtures thereof.

9. The liquid hydrocarbon motor fuel of claim 5 wherein $R_4$ is selected from the group consisting of primary alkyl ethers and mixtures thereof.

10. The liquid hydrocarbon motor fuel of claim 5 wherein $R_4$ is selected from the group consisting of nitro alkyls and mixtures thereof.

11. The liquid hydrocarbon motor fuel of claim 5 wherein $R_4$ is selected from the group consisting of nitrate esters and mixtures thereof.

12. The liquid hydrocarbon motor fuel of claim 1 or 3 or 5 wherein $R_1$ is an $—NO_2$ radical.

13. The liquid hydrocarbon motor fuel of claim 1 or 3 or 5 wherein $R_1$ is a lower alkyl.

14. The liquid hydrocarbon motor fuel of claim 13 wherein said lower alkyl is selected from the group consisting of methyl, ethyl, propyl and butyl.

15. The liquid hydrocarbon motor fuel of claim 14 wherein said lower alkyl is methyl.

* * * * *